US012747071B2

(12) United States Patent
Colomer Casas et al.

(10) Patent No.: US 12,747,071 B2
(45) Date of Patent: Sep. 29, 2026

(54) CLOSURE SYSTEM FOR LIDDED CONTAINERS

(71) Applicant: QUADPACK INDUSTRIES S.A., L'Hospitalet de Llobregat (ES)

(72) Inventors: Joan Colomer Casas, L'Hospitalet de Llobregat (ES); Eduard Machado Eguzquiza, L'Hospitalet de Llobregat (ES); David Merino De Diego, L'Hospitalet de Llobregat (ES)

(73) Assignee: QUADPACK INDUSTRIES, S.A.

( * ) Notice: Subject to any disclaimer, the term of this patent is extended or adjusted under 35 U.S.C. 154(b) by 0 days.

(21) Appl. No.: 18/278,938

(22) PCT Filed: Feb. 25, 2021

(86) PCT No.: PCT/ES2021/070140

§ 371 (c)(1),
(2) Date: Aug. 25, 2023

(87) PCT Pub. No.: WO2022/180283

PCT Pub. Date: Sep. 1, 2022

(65) Prior Publication Data

US 2024/0132258 A1 Apr. 25, 2024
US 2024/0228126 A9 Jul. 11, 2024

(51) Int. Cl.
*B65D 43/02* (2006.01)

(52) U.S. Cl.
CPC ..... *B65D 43/0231* (2013.01); *B65D 2543/00537* (2013.01)

(58) Field of Classification Search
CPC ..... B65D 43/0231; B65D 2543/00537; B65D 2543/00083
USPC ..... 206/822
See application file for complete search history.

(56) References Cited

U.S. PATENT DOCUMENTS 1,445,068 A * 2/1923 Peter ..... B65D 43/0231 16/DIG. 30
2009/0008391 A1* 1/2009 Bjorkholm ..... B65D 43/0212 220/315

* cited by examiner

*Primary Examiner* — Jeffrey R Allen
(74) *Attorney, Agent, or Firm* — Stanzione & Associates, PLLC; Patrick Stanzione

(57) ABSTRACT

A closure system for lidded containers that includes a body having a neck with at least one opening which is covered by a lid. The neck includes at least a mouth that defines the opening and a recess in the walls of the neck. The mouth and recess include an elliptical shape. The lid includes an extension shaped as an ellipse directed towards the inner side of the lid. The ellipse of the mouth is smaller than the ellipse of the lid, the recess has a frustoconical configuration that defines an angle α, and the extension has, in its inner face, an inverted frustoconical configuration with respect to the frustoconical configuration of the recess, having an angle β, and the extension includes a salient flank which is located in the recess.

8 Claims, 5 Drawing Sheets

CLOSURE SYSTEM FOR LIDDED CONTAINERS

Closure system for lidded containers, of the type comprising a body with a neck that comprises at least one opening that is covered by a lid, characterized in that: the neck comprises at least one mouth that defines the opening, and a recess in the walls of the neck, both the mouth and the recess having the shape of an ellipse, being the major axis of the ellipse of the mouth and of the recess between 5-15% longer than the minor axis; the lid comprises an ellipse-shaped extension directed towards the inner part of the lid, the major axis of the ellipse of said extension being about 5-15% longer than the minor axis thereof, the ellipse of the mouth is smaller than the ellipse of the lid, the recess has a frustoconical configuration, which defines an angle $\alpha$, and the extension has, in its inner face (which inner face being located opposite to the recess), an inverted frustoconical configuration with respect to the frustoconical configuration of the recess, forming angle $\beta$, and the extension comprises a silent flank which is located in the recess, which, when in a closed position, at least a part of the extension rubs against the walls of the recess and locks the lid to the body, and which, when in an open position, when the cap is rotated around the rotation axis of the body in the opposite direction to that which had been used for closing, causes the lid to be released from the body, and, if the rotation is continued in the same direction of rotation, the lid is locked back to the body and rubs against a part of the extension with the recess walls.

BACKGROUND OF THE INVENTION

Different closing systems for containers with shapes that are not strictly circumferential are known in the state of the art.

Thus, British Patent 183040 "IMPROVEMENTS IN CLOSURES FOR BOTTLES", of the year 1821, in the name of BRATBY & HINCHLIFFE LIMITED, belongs to the state of the art, which refers to a bottle adapted to be closed by means of crown cap built with lips that are projected diametrically to two opposite sides of the mouth of the bottle and having flat curves on the other two sides; which gradually and unperceptively merge with the former and take and oval shape to receive all of the standard crown cap; the sealing rubber of the crown cap couples underneath the lips when it is substantially compressed, as described.

Also known is U.S. Pat. No. 4,134,513 "CHILD-RESISTANT SAFETY CLOSURE", of the year 1977, in the name of OWENS-ILLINOIS INC, which refers to a child-resistant, safety closure for a container having a dispensing end including a threaded neck portion onto which the closure is adapted to be threadably assembled. The closure includes an interiorly threaded sidewall having a flexible and resiliently distensible distal end portion provided with at least one interlocking member on its interior surface adapted to automatically interlockingly engage at least one complementary interlocking member on the dispensing end of the container when the closure is in either a fully closed or in at least one additional, partially removed position on the container neck portion. Removal of the closure, requires manual compression of the flexible distal end of the sidewall; applied at locations straddling the interlocking members, coupled with concurrent retrogressive movement of the closure, which ordinarily must be repeated at each interlocking position of the closure, and, therefore, requires both manual dexterity and knowledgeable intent beyond the capability of young children or other persons of comparable capabilities. Moreover, as a further safety factor, the interlocking members are isolated in an inaccessible and unobservable way, within the interior confines of the closure when it is interlocked on the container.

State of the art if also U.S. Pat. No. 4,204,605 "CONTAINER-CLOSURE ASSEMBLY", of the year 1978, in the name THE WEST COMPANY, which refers to a container-closure assembly. The container has a discharge opening, a locking flange of generally circular opening with a frustoconical side face diverging downwardly from the axial end face of the opening. A shaping surface is formed below the locking flange of non-circular cross section and has a maximum cross section less than the cross section of the locking flange and at least one cam member extends axially downwardly from the locking flange. The cap of the assembly has a top and a peripheral skirt portion engaging under the locking flange and extending at least to the juncture of the locking flange and shaping surface. The cap is of a deformable material whereby the skirt is shaped to a generally circular shape by the cam member upon relative rotation of the cap and container.

Last, also known is U.S. Pat. No. 4,588,097 "SAFETY CLOSURE CAP FOR CONTAINERS", of the year 1985, in the name of Ivo J HAUSER, which refers to a safety closure cap for containers in which the cap is pressed onto a container neck. The cap skirt comprises two or more pressure points for distorting the cap. The cap also includes expansion areas and means for fixing the rotational position of cap to container. The expansion areas contain closure segments which engage an endless closure bead located on the container neck. By means of rotating the cap to a predetermined position and by means of finger pressure applied on the pressure points the cap skirt is deformed which results in a deflection of the expansion areas in a radial direction and disengages the closure segments from the closure cord to allow the cap to be lifted from the container.

BRIEF DESCRIPTION OF THE INVENTION

The present invention refers to the field of lids for closing containers.

The nearest document is Patent GB183040.

Said patent solves the problem of allowing to easily open bottles closed by means of crown lids, by configuring the flanges of the container mouth, which define an oval mouth.

However, said patent has the disadvantage that to open the container either a tool (opener) must be used—and consequently the crown lid cannot be reused because it will be distorted upon opening—or otherwise an upwards angular force must be exerted to release the grooves, which could cause injury to the fingers and which not every user would be able to open.

The present invention solves the above-described problem by providing two ellipses, one at the mouth of the container and another one in the lid, having the characteristics described in the following paragraphs, so that when the lid is closed over the mouth, if it is rotated towards a certain direction, the cap is released; if rotated in the opposite direction, the cap would only squeeze the closing further, and, if the user keeps on rotating towards the same direction, the lid would be closed over the mouth again. This means that the force needed to close the lid over the body is little, which allows everyone to be able to open and close the container with a minimum effort.

An object of the present invention is a closure system for lidded containers of the type comprising a body with a neck that comprises at least one opening that is covered by a lid, characterized in that: the neck comprises at least one mouth that defines the opening, and a recess in the walls of the neck, both the mouth and the recess having the shape of an ellipse, being the major axis of the ellipse of the mouth and of the recess between 5-15% longer than the minor axis; the lid comprises an ellipse-shaped extension directed towards the inner part of the lid, the major axis of the ellipse of said extension being about 5-15% longer than the minor axis thereof, the ellipse of the mouth is smaller than the ellipse of the lid, the recess has a frustoconical configuration, which defines an angle α, and the extension has, in its inner face (which inner face being located opposite to the recess), an inverted frustoconical configuration with respect to the frustoconical configuration of the recess, forming angle β, and the extension comprises a silent flank which is located in the recess, which, when in a closed position, at least a part of the extension rubs against the walls of the recess and locks the lid to the body, and which, when in an open position, when the cap is rotated around the rotation axis of the body in the opposite direction to that which had been used for closing, causes the lid to be released from the body, and, if the rotation is continued in the same direction of rotation, the lid is locked back to the body and rubs against a part of the extension with the recess walls.

BRIEF DESCRIPTION OF THE DRAWINGS

To facilitate the explanation, this description includes five sheets with drawings that represent a practical embodiment hereof, which is cited by way of a nonlimiting example of the scope of the present invention.

SPECIFIC EMBODIMENT OF THE INVENTION

Figure 1:
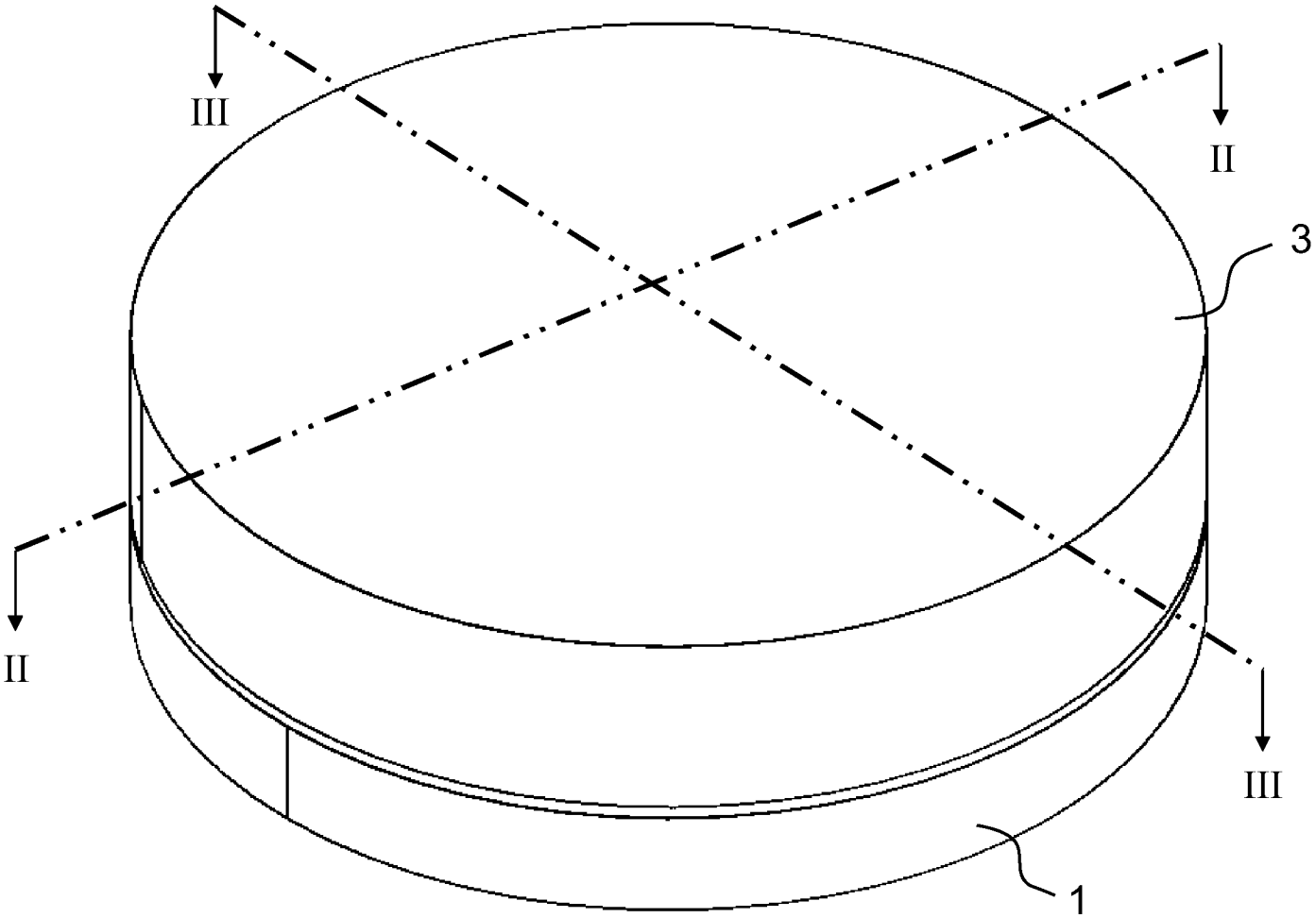
FIG. 1 is a general view of the object of the present invention.

FIG. 1 illustrates a body 1 and a lid 3.

Figure 2:
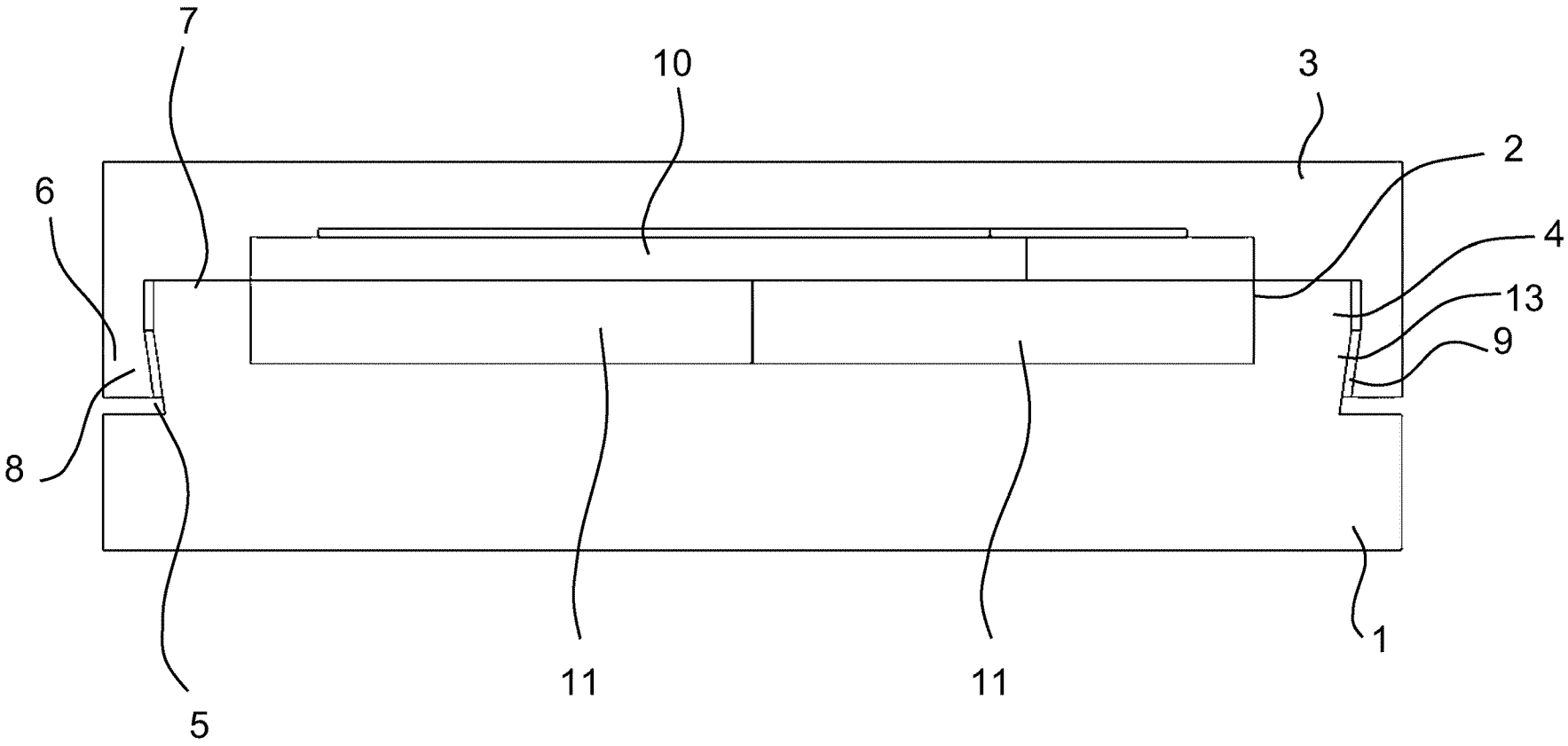
FIG. 2 es is a section along line II-II of FIG. 1.

FIG. 2 represents the body 1 with its neck 4, its cosmetic product 11, its mouth 7 and its opening 2; a cap 3 having its extensions 6 and an inner face 9 of the extensions, its silent flank 8, a mirror 10 and a recess 5 with its recess wall 13.

Figure 3:
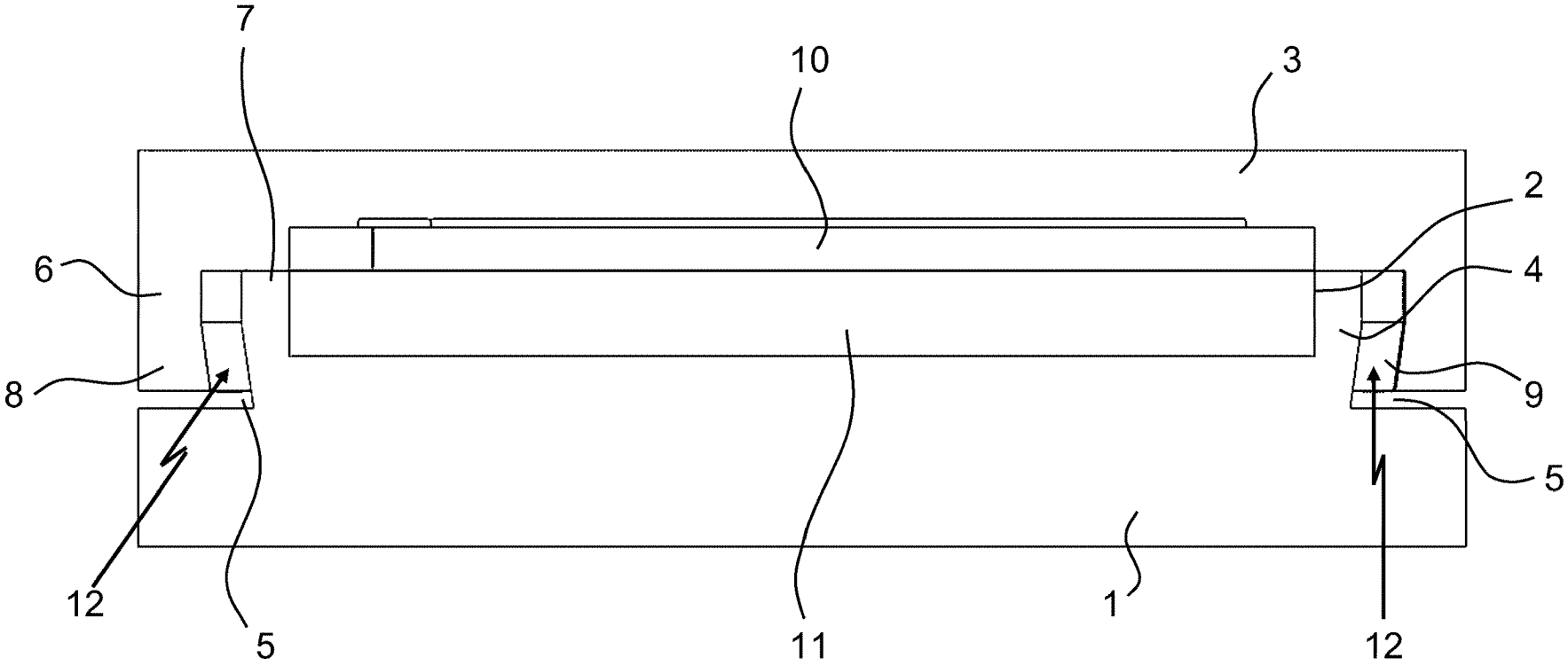
FIG. 3 is a section along line III-Ill of FIG. 1.

FIG. 3 shows a body 1 with its neck 4, its cosmetic product 11, its mouth 7 and its opening 2; a lid 3, with its extensions 6 and the inner face 9 of the extension, its silent flank 8, mirror 10, a passage 12 and recess 5.

Figure 4:
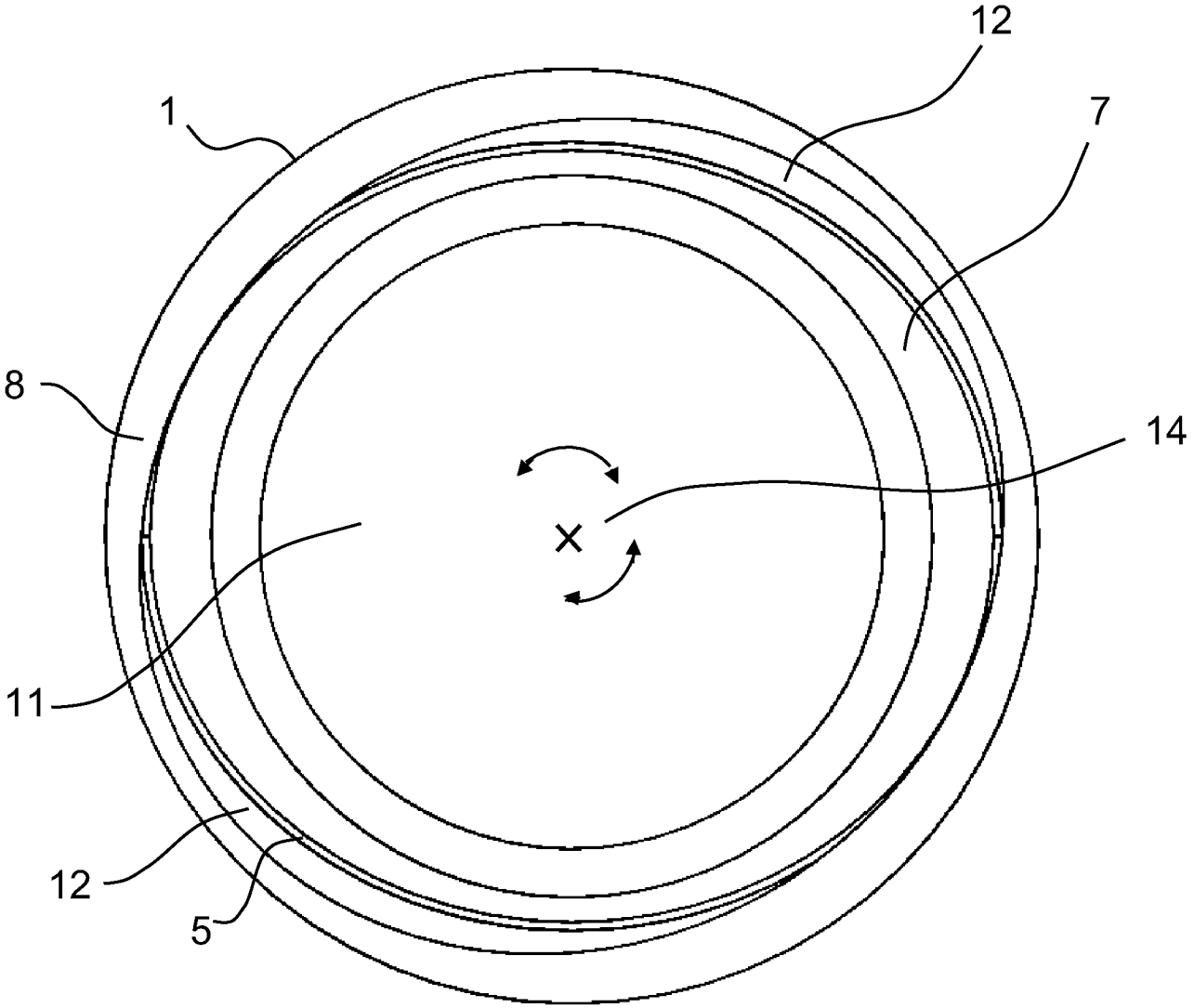
FIG. 4 is a bottom view, with transparency of the container, with the container assembly in a closed position.

FIG. 4 illustrates body 1, mouth 7, a rotation axis 14, cosmetic product 11, recess 5, silent flank 8 and passage 12.

Figure 5:
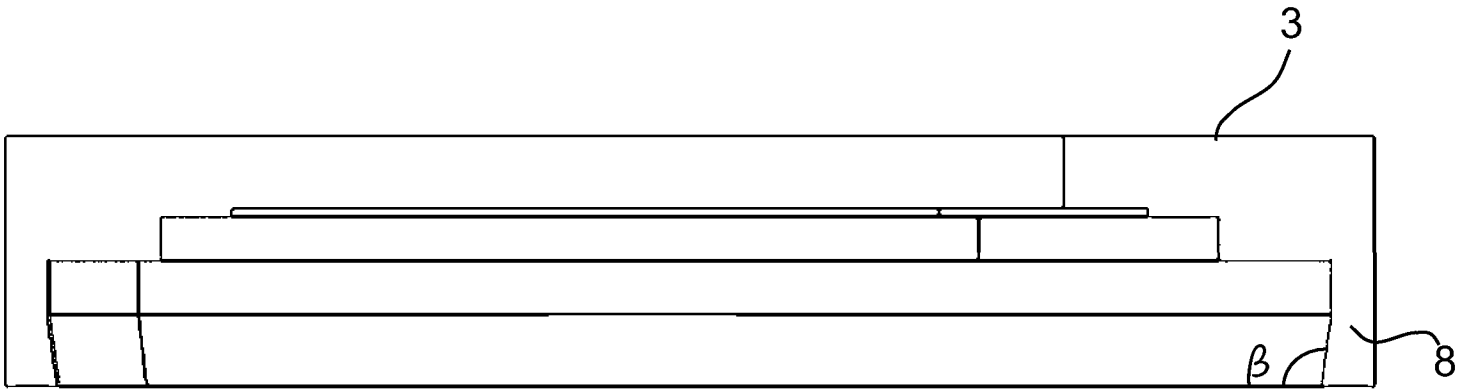
FIG. 5 is a separate view of FIG. 2 that refers to the lid, showing angle β.

FIG. 5 shows lid 3, silent flank 8 and angle β.

Figure 6:
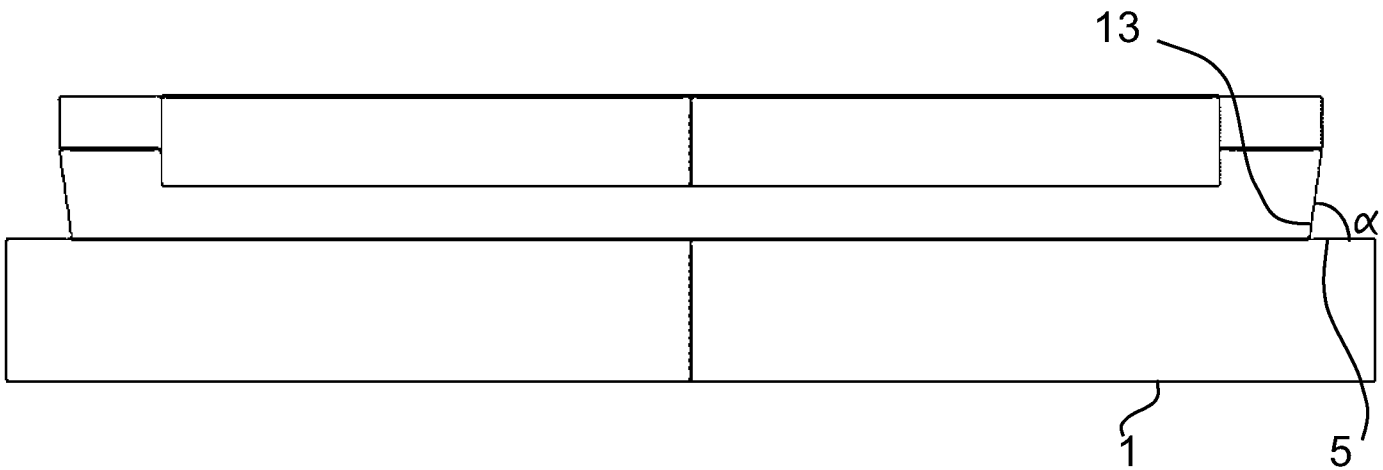
FIG. 6 is a separate view of FIG. 2 that refers to the body, showing shows angle α.

Last, FIG. 6 represents body 1, recess 5 with wall 13, and angle α.

Thus, the closure system for lidded containers comprises a body 1 having a neck 4. The neck 4 comprises at least one opening 2 which is covered by a lid 3. There is at least one opening 2. However, there could be two or more separate receptacles for two or more cosmetic products and therefore there would be more than one opening.

The neck 4 comprises at least one mouth 7, and the same explanation provided above for opening 2 applies, which neck 4 defines opening 2. The neck 4 comprises a recess formed in the walls of the neck 4.

Both the mouth 7 and the recess 5 have an elliptic shape. Furthermore, since the ellipse, by definition, has a major axis and a minor axis, in this case the major axis of the mouth 7 and the major axis of the recess 5 are 5-15% longer than the respective minor axis of the mouth and the recess.

The lid 3 comprises an extension 6 also having an elliptical shape directed towards the inner side of the lid 3; the major axis of the ellipsis of the extension 6 being between 5-15% longer than the minor axis.

Likewise, the ellipse of the mouth 7 is smaller than the ellipse of lid 3.

The recess 5 has a frustoconical configuration, wall 13 being inclined, thus defining an angle α, as shown in FIG. 6.

This angle α will be preferably within a range of 45° and 89°, and, more exactly, as shown in the present embodiment, between 80 and 85°.

Likewise, the extension 6, in its inner face 9, which is located opposite to the recess 5, has an inverted frustoconical configuration with respect to the frustoconical configuration of recess 5 (as shown in FIG. 2). That is, the inner face 9 of the extension could be coupled with the wall 13 of the recess 5, at an angle β (as sown in FIG. 5).

Optionally, angle β is supplementary to angle α. Two angles are supplementary when the sum of both angles is 180°. That is, if angle α is 80°, then angle β will be 100°.

Extension 6 comprises a salient flank 8, that is located in the recess 5.

When in the closed position, at least one part of extension 6 rubs against the walls 13 of the recess 5 and locks lid 3 to body 1.

When in the open position, when the lid 3 is rotated around the rotation axis 14 of the body 1 in the opposite direction to that used for closing, the lid 3 is released from the body 1.

When rotation towards the same direction is continued, the lid 3 is locked to the body 1 once again, rubbing a part of the extension 6 with the recess walls 5.

Optionally, salient flank 8 can be either rigid or flexible, depending on the materials used.

In addition, salient flank 8 may optionally take the shape of a tooth, which shape allows a better fitting and lugging inside the recess.

In a practical embodiment, the user would hold the lid 3 and would place it on the body 1.

Next, the user would rotate the lid 3 around the rotation axis 14 in a direction of rotation, for example, towards the left, until the salient flank 8 enter the recess 5. The action is continued in the same rotation direction (towards the left) until salient flank 8 interfere with the wall 13 of the recess 5, and the lid is locked to the body 1.

To open, one would perform the opposite action, by rotating the lid 3 around the rotation axis 14 in the opposite direction to the previous action, that is, towards the right, until reaching the point in which the tabs 8 are outside the recess 5 and the lid 3 may be removed.

However, if the rotation is continued in the same direction, towards the right, the salient flank 8 would end up interfering again with the walls 9 of the opposite end of the recess and would block the advance of the rotation, closing lid 3 over the base 1.

That is, the salient flank 8 interfere with the recess 5 as they approach the end of the major diameter of the ellipse of recess 5 in body 1 and the tabs are released as they move away from the major diameter of the ellipse and as they approach the minor diameter of the ellipse of recess 5 of body 1.

The salient flank 8 and the body 1 can be made of one same material, such as wood (either rigid or an elastic, depending on the type of wood used; teak is not very elastic, bamboo is elastic, or, depending on the procedure or treatment to which the wood is subjected), or plastic (which can be rigid or elastic, depending on the type of plastic); or they can be made of different materials, such as glass (a rigid material), or cork (basically an elastic material that can also be rigid), or porcelain (a rigid material), and rubber (elastic material).

Those combinations are provided by the needs of the client. For example, if the container needs to be airtight, the material to be used should have those properties, like a gasket, using rubber or plastic materials for the fitting. If, on the contrary, the sealing needs not be perfectly accurate, such as it is in the case of certain make up cosmetics, wood may be used.

The present invention describes a new closure system for lidded containers. The examples mentioned herein are not limitative of the present invention, and the invention may therefore have different applications and/or adaptations, all of which within the scope of the following claims.

The invention claimed is:

1. A closure system for lidded containers, the system comprising:

a body (1) having a neck (4) that includes at least one opening (2) and at least one mouth (7) defining the opening (2), and a recess (5) formed in an outer wall of the neck (4), both the mouth (7) and the recess (5) being entirely elliptical in shape with a major axis of the elliptical mouth (7) and the recess (5) being 5-15% longer than a minor axis thereof; and an elliptical lid (3) including a corresponding elliptical extension (6) directed towards an inner part of the lid (3), a major axis of the elliptical extension (6) being 5-15% longer than a minor axis thereof;

wherein:

the ellipse of the mouth (7) is smaller than the ellipse of the lid (3), the entire recess (5) has a frustoconical configuration that defines an angle $\alpha$, and the extension (6), in its inner face (9), which is located opposite the recess (5), has an inverted frustoconical configuration with respect to the frustoconical configuration of the recess (5), having an angle $\beta$, said extension (6) comprising a salient flank (8) that is located in the recess (5), which when in a closed position at least part of the extension (6) rubs against the recess (5) and locks the lid (3 to the body (1), when in an open position, when rotating the lid (3) around the rotation axis (14) of the body (1) in an opposite direction to the one that had been applied for closing, the lid (3) is released from the body (1), and when continuing the rotation in the same direction the lid (3) is locked again to the body (1) rubbing a section of the extension (6) with the recess walls (5).

2. The system according to claim 1, wherein the salient flank (8) is made of a rigid material.

3. The system according to claim 1, wherein the salient flank (8) is made of an elastic material.

4. The system according to claim 1, wherein the salient flank (8) is shaped as a tooth.

5. The system according to claim 1, wherein the angle $\alpha$ is between 45° and 89° relative to a plane perpendicular to a longitudinal axis of the closing system.

6. The system according to claim 5, wherein the angle $\alpha$ is between 8° and 85° relative to a plane perpendicular to a longitudinal axis of the closing system.

7. The system according to claim 5, wherein the angle $\beta$ is supplementary to angle $\alpha$.

8. The system according to claim 6, wherein the angle $\beta$ is supplementary to angle $\alpha$.

* * * * *